US010962245B2

(12) United States Patent
Cai

(10) Patent No.: US 10,962,245 B2
(45) Date of Patent: Mar. 30, 2021

(54) HUMIDIFIER TO WHICH WATER IS SUPPLIED FROM THE TOP

(71) Applicant: Foshan Jinxinghui Electrical Appliance Co., LTD., Foshan (CN)

(72) Inventor: Jingbo Cai, Foshan (CN)

(73) Assignee: Foshan Jinxinghui Electrical Appliance Co., LTD., Foshan (CN)

( * ) Notice: Subject to any disclaimer, the term of this patent is extended or adjusted under 35 U.S.C. 154(b) by 260 days.

(21) Appl. No.: 15/978,482

(22) Filed: May 14, 2018

(65) Prior Publication Data

US 2019/0024915 A1 Jan. 24, 2019

(30) Foreign Application Priority Data

Jul. 24, 2017 (CN) ..... 201720904687.0

(51) Int. Cl.
*F24F 6/12* (2006.01)
*F24F 6/00* (2006.01)
*F24F 13/02* (2006.01)

(52) U.S. Cl.
CPC ..... *F24F 6/12* (2013.01); *F24F 13/02* (2013.01); *F24F 13/0209* (2013.01); *F24F 2006/008* (2013.01)

(58) Field of Classification Search
CPC ..... F24F 6/12; F24F 2006/008; F24F 6/02; F24F 13/20; F24F 11/30; F24F 6/08; Y02B 30/70; B01F 3/04021; G05D 9/12; Y10T 137/7501; F16K 11/00
See application file for complete search history.

(56) References Cited

U.S. PATENT DOCUMENTS 4,087,495 A * 5/1978 Umehara ..... F24F 6/12 261/81
4,257,989 A * 3/1981 Nishikawa ..... B05B 12/08 261/4
4,663,091 A * 5/1987 Seo ..... A61L 2/035 210/748.01

(Continued)

FOREIGN PATENT DOCUMENTS

CN 204853787 * 12/2015
CN 204902093 * 12/2015

OTHER PUBLICATIONS

"Coupling" Wikipedia published Oct. 15, 2015 accessed at <https://en.wikipedia.org/w/index.php?title=Coupling&oldid=685823929> (Year: 2015).*

(Continued)

*Primary Examiner* — Stephen Hobson
(74) *Attorney, Agent, or Firm* — Edwin A. Sisson, Attorney at Law, LLC; Jeffrey J. Banyas

(57) ABSTRACT

A high-safety humidifier to which water is supplied from the top is provided, comprising a pedestal, a water tank and a fan, wherein a trough is provided on the pedestal and an atomization device is provided in the trough; the fan is provided on the pedestal, and a wind outlet of the fan is connected to a mist discharge passage via a wind pipe. The wind outlet of the fan is higher than or the horizontal section of the wind pipe is at least partially higher than the level of the lowest connection point between the water tank and the pedestal; and, the water tank and the pedestal are detachably connected in a sealed manner.

15 Claims, 7 Drawing Sheets

(56) References Cited

U.S. PATENT DOCUMENTS

| | | | | |
|---|---|---|---|---|
| 5,483,616 | A * | 1/1996 | Chiu | F24F 6/043 261/107 |
| 5,792,390 | A * | 8/1998 | Marino | F24F 6/00 215/359 |
| 6,244,576 | B1 * | 6/2001 | Tsai | F24F 6/02 261/141 |
| 7,654,508 | B2 * | 2/2010 | Wegner | F24F 6/14 261/34.1 |
| 9,157,644 | B2 * | 10/2015 | Hou | F24F 6/02 |
| 9,316,405 | B2 * | 4/2016 | Moon | F24F 3/1603 |
| 10,161,643 | B2 * | 12/2018 | Son | F24F 6/04 |
| 2011/0156288 | A1 * | 6/2011 | Ahn | F24F 6/12 261/30 |
| 2012/0234166 | A1 * | 9/2012 | Markham | F24F 3/1603 95/214 |
| 2016/0356514 | A1 * | 12/2016 | Cai | F24F 11/0008 |
| 2017/0082306 | A1 * | 3/2017 | Murakami | F24F 3/14 |
| 2017/0122588 | A1 * | 5/2017 | Lee | F24F 6/14 |
| 2019/0024915 | A1 * | 1/2019 | Cai | F24F 6/12 |
| 2019/0041086 | A1 * | 2/2019 | Atkins, Jr. | F24F 6/12 |

OTHER PUBLICATIONS

"Buckle" Wikipedia published Dec. 14, 2015 accessed at <https://en.wikipedia.org/w/index.php?title=Buckle&oldid=695244413> (Year: 2015).*

Philips Respironics Tank Bottom for DreamStation Go Heated Humidifier Chambers _ cpapdirect.com (Year: 2020).*

EPO translation of CN 204902093 (Year: 2015).*

Philips Respironics Tank Bottom for DreamStation Go Heated Humidifier Chambers _ cpapdirect.com (Year: 2020) (Year: 2020).*

EPO translation of CN 204902093 (Year: 2015) (Year: 2015).*

* cited by examiner

HUMIDIFIER TO WHICH WATER IS SUPPLIED FROM THE TOP

CROSS REFERENCE TO RELATED APPLICATION

The present application claims the priority of Chinese Patent Application NO. 201720904687.0, filed on Jul. 24, 2017, the disclosure of which is incorporated by reference herein in its entirety.

TECHNICAL FIELD

The present application relates to a humidifier, in particular a humidifier to which water is supplied from the top.

BACKGROUND

With the improvement of living conditions, people propose higher requirements on the comfort of the living environment. Air humidity is one of important factors that influence the comfort. Especially in the north of China and in any places that require air-conditioning, the air is dry. Therefore, humidifiers are increasingly indispensable to many families.

At present, the commercially available humidifiers are almost humidifiers with a separate water tank having a water supply port formed on its bottom. For such humidifiers to which water is supplied from the bottom, the user is required to lift the water tank up by a handle, place the water tank upside down so that the bottom of the water tank faces upward, open the water supply port cover, which is used to seal the water supply port, on the bottom of the water tank, fill the water tank with water from the water supply port, and then seal the water supply port by the water supply port cover after the water tank is filled with water. The whole water supply process is complex and it is quite inconvenient for less strong users, for example, the elderly and women, since the water tank is very heavy after it is filled with water. The water supply port cover has a function of sealing the water supply port, and generally, it is necessary to tighten the water supply port cover to seal the water supply port when in use, in order to form negative pressure in the water tank to avoid leakage of water. Furthermore, since the water supply port cover is located in a small space between the water tank and the pedestal, it should not be very large and thus there is a small contact area that can generate a frictional rotary force when held by user. Moreover, since the cover has a small radius of rotation, screwing or unscrewing the water supply port cover is very laborious. It will be very difficult for weak persons, for example, the elderly, to open the water supply port cover. In addition, since a controllable air supplementation and water drainage device is often provided on the water supply port cover, by which air enters the water tank so that water in the water tank flows into the atomization trough in a controllable way after the water level in the atomization trough lowers, the air supplementation and water drainage device may be triggered by an uncoordinated action when screwing or unscrewing the water supply port cover with an excessive force, resulting in damage. Therefore, a structure integrating a water supply device and a water drainage device is easily damaged during the normal use. To solve the above problem, humidifiers to which water is supplied from the top have been developed. A water tank cover is provided on the top of the water tank, so that water can be directly supplied by opening the water tank cover. This is quite convenient for the user.

In such a humidifier to which water is supplied from the top, the water tank is erected over the pedestal, the water tank and the pedestal are often formed by one-step injection molding. However, since functional components or mounting structures, for example, a mist discharge passage, an air duct, a trough and a water drainage port, are to be formed on the water tank and the pedestal by injection molding, the mold and the injection molding process will often become very complex, and the manufacture cost will be increased greatly. In addition, the flowing of water in the water tank into the trough in a controllable way by opening or closing the water drainage device in the water tank is often realized by a water level control device. However, since there may be unexpected objects such as hair in water, the water level control device will fail to function once the unexpected objects are stuck in the water level control device. As a result, water in the water tank will flow to the trough continuously. However, the wind outlet of the fan in a traditional humidifier is arranged beside the trough and in a lower position. The wind outlet of the fan will be flooded when the water level in the trough rises to a certain height, and water will flow back to the fan to damage the fan and its accessory circuits.

Accordingly, how to design a humidifier to which water is supplied from the top, which can avoid the laborious overturn and movement of the water tank and the laborious opening of the water supply port cover, and also share the simple process and low cost of the mold due to the separated design of the water tank and the pedestal, has become the target of both consumers and the humidifier industry.

Based on years of experience in research, development and production of various household appliances and by repeated research and demonstration, the inventor of the present application eventually designs a humidifier to which water is supplied from the top.

SUMMARY

An objective of the present application is to provide a humidifier to which water is supplied from the top, which has advantages of high safety, low cost, simple manufacture process and easy use.

The humidifier to which water is supplied from the top in the present application includes a pedestal, a water tank and a fan. A trough is provided on the pedestal and an atomization device is provided in the trough. A wind outlet of the fan is connected to a mist discharge passage by an air duct, and a mist discharge port, from which mist generated by the atomization device is discharged, is formed in the mist discharge passage. A water inlet is formed in an upper portion of the water tank, and a water drainage port is formed on the water tank. A water drainage device is provided at the water drainage port, and the water drainage device can be triggered to open or close by receiving an electric signal, a magnetic signal or a mechanical action. On the humidifier to which water is supplied from the top, a water level control device configured to generate an electric signal or a magnetic signal or a mechanical action as per the water level in the trough is provided. The wind outlet of the fan is higher than or the horizontal section of the wind pipe is at least partially higher than the water level of the lowest connection point between the water tank and the pedestal, and the water tank and the pedestal are detachably connected in a sealed manner.

To ensure higher safety, the wind outlet of the fan is higher than or the horizontal section of the wind pipe is at least partially higher than the level after 50% of the water storage capacity of the water tank is filled. Lots of data statistics and research have shown that, generally, consumers rarely fill the water tank up with water and they usually fill the water tank with a certain amount of water due to the convenience of supplying water to the water tank from the top. In a case of water leakage from the water tank, even if water does not flow out of the humidifier, there is a 97% chance that the water level in the water tank will lower to below the level of 50% of the maximum water storage capacity, and a 99.999% chance that the water level in the water tank will lower to below the level of 98% of the maximum water storage capacity. Therefore, if the wind outlet is at or the horizontal section of the wind pipe is at least partially at a height above the level of 50%-98% of the maximum water storage capacity of the water tank, and if the wind outlet is higher than or the horizontal section of the wind pipe is at least partially higher than the level of 50% of the maximum water storage capacity of the water tank, due to a low probability of water leakage, it is possible to avoid the flow of water into the fan with a high probability as long as the wind outlet is higher than or the horizontal section of the wind pipe is at least partially higher than the level of 50% of the maximum water storage capacity of the water tank. And, since a too long air duct will influence the strength of wind at the wind outlet of the wind pipe, need a large space, increase the difficulty in implementation, and affect the appearance, such a design takes both the possibility of malfunctions and the convenient implementation and efficiency of products into consideration. By ensuring that the wind outlet is at or the horizontal section of the wind pipe is at least partially at a height above the level of 50%-98% of the maximum water storage capacity of the water tank, the air duct is not higher than the water tank. This can be applicable to some special designs and appearance-enhanced designs where the exposure of air ducts is unexpected. In this way, an optimal design is obtained.

The water drainage device and the water level control device described above have been widely applied in humidifiers, so their structures and operating principles will not be repeated here. Since the water tank and the pedestal are detachably connected in a sealed manner, the water tank can be separated from the pedestal. The user can carry the water tank and fill it with water separately. The operation is more flexible. This also avoids the flow of water in the water tank out of the humidifier along the junction of the water tank with the pedestal when the water level control device fails to function because of unexpected objects or the like.

Specifically, there are following ways of detachably connecting the water tank and the pedestal in a sealed manner.

1. The joined end faces of the pedestal and the water tank are detachably sealed, specifically:

a. A sealing ring is provided on the top surface of the pedestal and/or the bottom surface of the water tank, and the sealing between the water tank and the pedestal is realized by compressing the sealing ring by the water tank.

b. A sealing surface made of flexible material is provided between the top surface of the pedestal and/or the bottom surface of the water tank, and the sealing between the water tank and the pedestal is realized by compressing the sealing surface by the water tank. Compared with the way of sealing by using a sealing ring as described in a, the sealing surface does not have high requirements on the accuracy of the relative position between the water tank and the pedestal, the sealing effect is more reliable and it is more convenient to place the water tank.

2. The side edge of the pedestal and the side edge of the water tank are detachably connected in a sealed manner. Specifically:

c. The humidifier to which water is supplied from the top further includes a sealing sleeve 400 which is sheathed at a junction of the pedestal with the water tank to detachably connect the side edge of the pedestal and the side edge of the water tank in a sealed manner. After the water tank is placed on the pedestal, the sealing sleeve is sheathed at the junction of the pedestal with the water tank. In this way, the sealed connection is realized by an additional sealing sleeve. The sealing sleeve may be made of elastic material, for example, rubber, to provide convenience for mounting and to ensure the compression against the water tank and the pedestal in order to avoid water leakage.

d. A recess 110 and a bump 210 fitted with each other are provided on the side edge of the pedestal and the side edge of the water tank, and a sealing ring is provided on a side wall of the recess and/or a side wall of the bump. The water tank and the base can be positioned by the recess and the bump, and after the water tank is placed on the pedestal, the side wall of the recess and the side wall of the bump will come into close contact. By the sealing ring, the sealed connection of the water tank and the pedestal can be realized. Preferably, the recess and the bump may be made in a truncated cone shape, in order to mount the water tank conveniently and ensure good sealing effect.

e. The pedestal and the water tank are detachably connected in a sealed manner by threads formed on the side edges.

Further, the mist discharge passage is formed by connecting the wind pipe and a mist pipe; the wind pipe is communicated with the wind outlet of the fan; the wind outlet of the wind pipe is communicated with the mist pipe in a lower portion of the mist pipe; and the mist discharge port is formed in an upper portion of the mist pipe. The flow direction of wind discharged from the fan in the present application is as follows: the fan→the wind outlet of the fan→the wind pipe→the mist pipe→the mist discharge outlet. Since the trough (the tough and the mist pipe form a mist discharge chamber due to the arrangement of the atomization device) is communicated with the mist discharge port, wind discharged from the fan flows from the lower portion of the mist pipe to the trough successively through the wind outlet of the fan and the wind pipe, and then blows out water mist generated within the trough from the mist discharge outlet through the mist pipe.

When the water level control device fails to function due to unexpected objects or the like, since there is generally no negative pressure in the water tank to which water is supplied from its top, water in the water tank will continuously flows into the trough until the water level in the trough is flushed with the water level in the water tank. Water in the trough will rise along the mist pipe and then flow into the wind pipe through the wind outlet of the wind pipe. If the wind outlet of the fan is designed at a higher position (for example, located above the wind pipe) or the wind outlet of the fan and the wind inlet of the wind pile are connected in a sealed manner and the wind pipe is designed at a higher position, water in the water tank is difficult to flow into the water outlet of the fan, so that the safety of the fan is ensured.

Specifically, the arrangement of the mist discharge passage has the following structures.

1. The wind pipe consists of a lower wind pipe and an upper wind pipe, the bottom end of the upper wind pipe is open and detachably connected to the wind outlet of the fan in a sealed manner, an upper portion of the upper wind pipe is communicated with the lower wind pipe, and the wind outlet of the wind pipe is formed in a lower portion of the lower wind pipe.

Since the bottom end of the upper wind pipe and the wind outlet of the fan are detachably connected in a sealed manner, water will not flow into the wind outlet of the fan through the junction of the bottom end of the upper wind pipe with the wind outlet of the fan even if the water level in the lower wind pipe and the water tank increases; and, only when the water level increases to the upper portion of the upper wind pipe, water will flow into the wind outlet of the fan along the upper wind pipe. However, generally, even if the water level control device fails to function, water in the water tank is insufficient to increase the height of the water level in the water tank to the high enough upper portion of the upper wind pipe. Therefore, the safety of the fan is ensured sufficiently.

Specifically, a sealing ring or a sealing surface is provided at the bottom end of the upper wind pipe and/or at the wind outlet of the fan; or, the bottom end of the upper wind pipe is muff-jointed with the wind outlet of the fan, and a sealing ring or a sealing surface is provided on a contact surface of the upper wind pipe with the wind outlet of the fan. With the two structures, the detachable connection of the bottom end of the upper wind pipe and the wind outlet of the fan in a sealed manner can be realized. When mounting, the assembly can be realized by butt-jointing the upper wind pipe with the wind outlet of the fan.

2. The bottom end of the wind pipe is open, the wind outlet of the fan extends upward into the wind pipe along the opening at the bottom end of the wind pipe, and the wind outlet of the fan is higher than the wind outlet of the wind pipe. When mounting, the wind pipe is sheathed downward on the wind outlet of the fan, and the wind pipe and the wind outlet of the fan are not needed to be connected in a sealed manner. The height of the wind outlet of the fan can be adjusted as per the capacity of the water tank, the capacity of the trough and the like. In this way, it is ensured that the wind outlet of the fan is still roughly higher than the water level, when water in the water tank flows into the trough to allow the water level in the water tank to be consistent with the water level in the trough in a case where the water level control device fails to function due to unexpected objects.

3. A bump protruded upward is provided on the pedestal, and the wind outlet of the fan is located in an upper portion of the bump and communicated with a fan through a fan wind duct within the bump; and, an upper end of the wind pipe is butt-jointed to the wind outlet of the fan, and the wind outlet of the fan is formed at a lower end of the wind pipe. With this structure, the position of the wind outlet of the fan is raised, and the possibility of the flow of water into the fan is reduced.

In the second and third structures, since the wind outlet of the fan is at a high position, even if the water level control device fails to function, water in the water tank is insufficient to increase the height of the water level in the water tank to the height of the wind outlet of the fan. Therefore, the safety of the fan is ensured sufficiently. In the third structure, since the wind duct of the fan is hidden within the bump, the space within the bump is utilized fully and the appearance is improved.

Further, buckles fitted with each other are provided on the pedestal and the water tank. After the water tank is placed on the pedestal, the buckles are buckled with each other, so that the firm connection and good sealing between the water tank and the pedestal are ensured.

Further, the mist discharge passage and the water tank are of an integrated structure. In this way, the trough can be cleaned after the water tank is taken down from the pedestal, so it is convenient for cleaning. Moreover, the mist discharge passage can be directly butt-jointed to the wind outlet of the fan when placed on the water tank. Certainly, it is also possible that the mist discharge passage and the water tank are of independent structures and can be detachably connected in a sealed manner. This structure is more flexible, and the humidifier is more diversified in shape.

In the humidifier to which water is supplied from the top of the present application, the way of connecting the wind duct structure and the water tank with the pedestal is improved, and a water tank detachable from the pedestal is provided. Molds can be fabricated for the water tank and the pedestal separately, and the mold fabrication and the injection molding process are simple. Since water is supplied to the water tank from its top, it is convenient for the water supply operation. The water supply port and the water drainage device are arranged separately, so that the possible mutual interface is avoided. Moreover, even if the water level control device fails to function, water in the water tank is difficult to flow into the fan or out of the humidifier, so that the safety in use is ensured.

BRIEF DESCRIPTION OF THE DRAWINGS

FIG. 7 is a sectional view of a humidifier to which water is supplied from the top in Embodiment 4, in which:

1: pedestal; 2: water tank; 3: trough; 4: wind output of the fan; 5: sealing ring on the pedestal; 6: mist pipe; 7: mist discharge port; 8: lower wind pipe; 9: upper wind pipe; 10: sealing ring at the wind outlet of the fan; 11: opening in the upper portion of the upper wind pipe; 12: wind outlet of the wind pipe; 13: wind pipe; 14: panel; 15: horizontal pipe; 16: vertical pipe; 17: wind duct of the fan; 18: horizontal rim; 19: sealing ring on the horizontal rim; and, 20: fan; 100: mist discharge passage; 200: water inlet; 400: sealing sleeve; 110: recess; 210: bump; 300: buckles.

DETAILED DESCRIPTION

The specific implementations of the present application, such as the shape and structure of involved components, the relative position relationship and connection relationship between components, and the function and working principle of components will be further described below in detail by embodiments with reference to the accompanying drawings.

Embodiment 1

Figure 1:
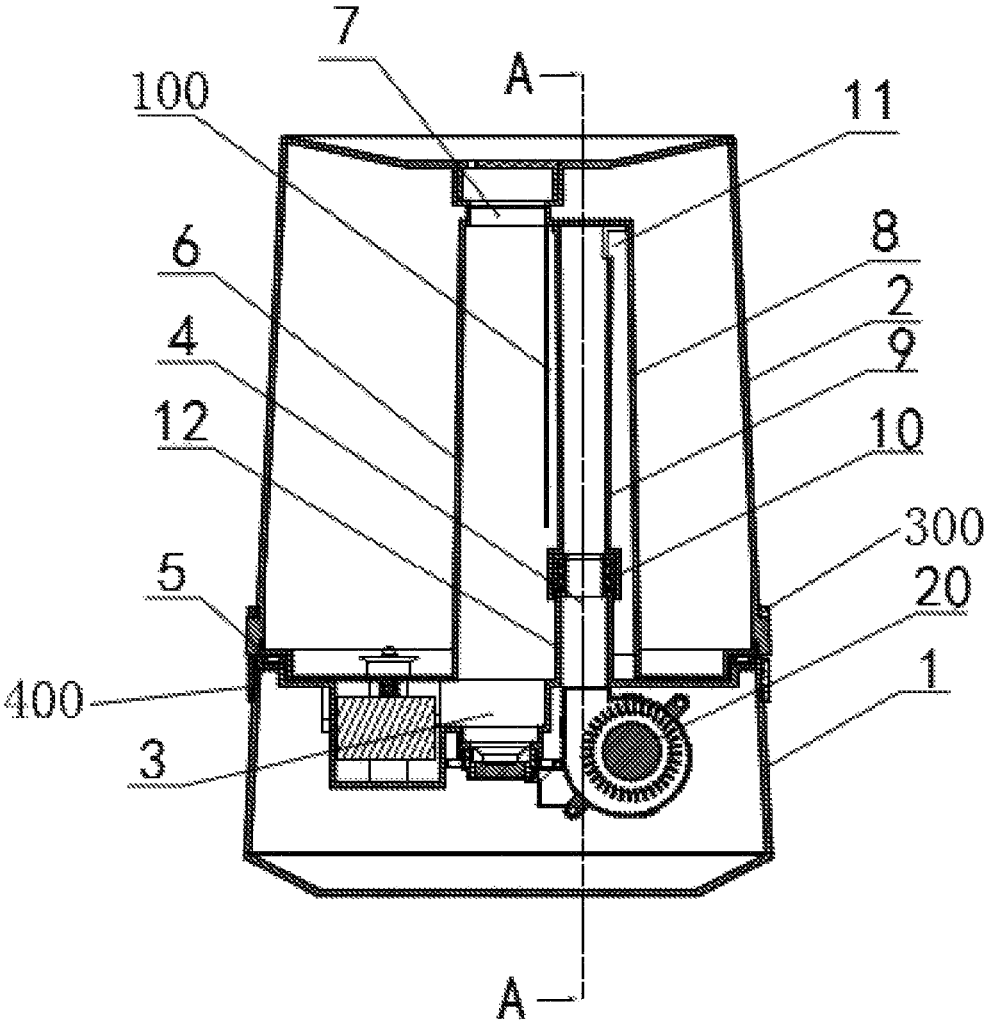
FIG. 1 is a sectional view of a humidifier to which water is supplied from the top in Embodiment 1.
Figure 2:
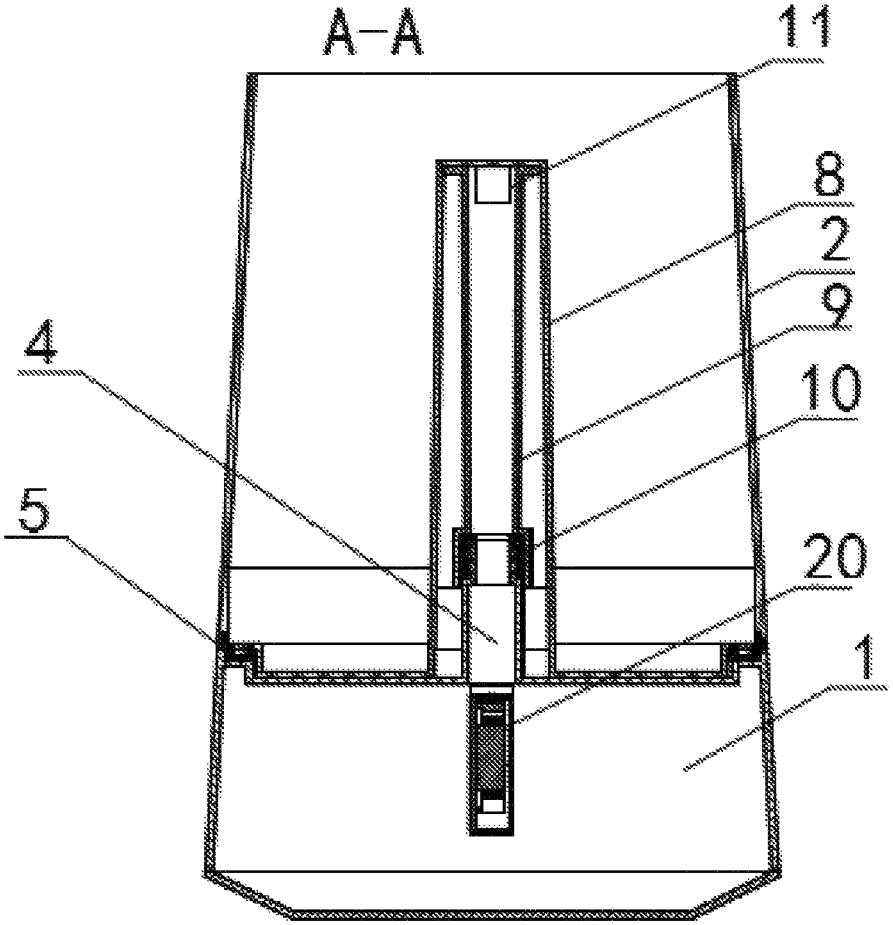
FIG. 2 is a sectional view of FIG. 1 taken along A-A.

Referring to FIGS. 1 and 2, the humidifier to which water is supplied from the top in this embodiment includes a pedestal 1, and a water tank 2 having a water inlet 200 formed on its top surface. A trough 3 is provided on the pedestal 1 and an ultrasonic atomization device is provided in the trough 3. A fan 20 may be mounted within the pedestal 1, and a wind outlet 4 of the fan is exposed upward out from the pedestal 1. A water drainage port is formed on the water tank 2. The water drainage port may be mounted on the bottom of the water tank, or may be mounted at a certain height away from the bottom of the water tank in order to prevent sediments accumulated on the bottom of the water tank from flowing into the trough. A water drainage device is mounted at the water drainage port. The water drainage device can be triggered to open or close by receiving an electric signal, a magnetic signal or a mechanical action so that water in the water tank 2 flows into the trough 3 in a controllable way. The water drainage device can be a solenoid valve, a rubber cover with a magnetic rod, a rubber cover with an ejector rod or the like, and can be triggered to open or close by receiving an electric signal, a magnetic signal or a mechanical action. A water level control device configured to generate an electric signal or a magnetic signal or a mechanical action as per to the water level in the trough 3 so as to control the water drainage device to open or close is provided in the trough 3. The water level control device can transfer the electric signal or the magnetic signal or the mechanical action to the water drainage device to control it to close or open. The electric signal can be generated by sensing the water level in the trough 3 by a sensor and then comparing the water level with a preset value in order to control the switch-on or switch-off of the solenoid valve of the water drainage device. The magnetic signal can be generated by sensing the water level in the trough 3 by a sensor, then comparing the water level with a preset value to determine the switch-on or switch-off of coil current, and generating a magnetic signal as per the coil current to control the magnetic rod of the water drainage device to move so as to drive the movement of the rubber cover of the water drainage device for realizing switch-on or switch-off. The mechanical action can be generated in such a way that a connecting rod and a floater connected to one end of the connecting rod are provided in the trough, the floater moves up and down along with the water level, a spindle is provided in the middle of the connecting rod, and the other end of the connecting rod can trigger the rubber cover with the ejector rod in the water drainage device to move for realizing switch-on or switch-off. Since the water drainage device and the water level control device can be implemented in various ways, the implementation way will not be listed one by one and will not be described in detail here. A sealing ring 5 is provided on an edge of the top surface of the pedestal 1, the water tank 2 is arranged on the pedestal 1, and the water tank 2 and the pedestal 1 are detachably connected in a sealed manner. Buckles 300 fitted with each other are provided on the pedestal 1 and the water tank 2. After the water tank 2 is placed on the pedestal 1, the buckles 300 are buckled with each other, so that the firm connection and good sealing between the water tank 2 and the pedestal 1 are ensured.

The water tank 2 is made of plastics, and a mist discharge passage 100 is integrally formed in a middle portion of the water tank 2. The mist discharge passage 100 is formed by connecting a wind pipe and a mist pipe 6 adjacent to each other. A lower portion of the mist pipe 6 is open and right faces the trough 3, the mist pipe 6 is fitted with the trough 3 to form an atomization chamber, and a mist discharge port 7 is formed on the top of the mist pipe 6. The wind pipe consists of a vertical lower wind pipe 8 and an upper wind pipe 9 sheathed in the lower wind pipe 8. The bottom end of the upper wind pipe 9 is open, and a searing ring 10 is provided on an outer wall of the top of the wind outlet of the fan. When mounting, the water tank 2 is pressed down, the upper wind pipe 9 is muff-jointed with the wind outlet 4 of the fan, and the sealed connection of the upper wind pipe and the wind outlet is realized by the sealing ring 10. An opening 11 communicated with the lower wind pipe 8 is formed a side of the upper portion of the upper wind pipe 9, and the wind pipe is communicated with the mist pipe 6 via a wind outlet 12 formed in the lower portion of the lower wind pipe 8.

The flow direction of wind discharged from the fan of the humidifier is as follows: the fan→the wind outlet 4 of the fan→the upper wind pipe 9→the lower wind pipe 8→the mist pipe 6→the mist discharge port 7. Wind discharged from the fan flows from the lower portion of the mist pipe 6 to the atomization chamber successively through the wind outlet 4 of the fan and the wind pipe, and then blows out water mist generated within the trough 3 from the mist discharge outlet 7 through the mist pipe 6.

When the water level control device fails to function due to unexpected objects or the like, water in the water tank 2 will continuously flow into the trough 3 until the water level in the trough 3 is flushed with the water level in the water tank 2. Water in the trough 3 will rise along the mist pipe 6, and then flow into the lower wind pipe 8 through the wind outlet 12 of the lower wind pipe 8. Since the wind outlet 4 of the fan and the wind inlet of the upper wind pipe 9 are connected in a sealed manner, water will not flow back to the wind outlet 4 of the fan even if the water level in the lower wind pipe 8 exceeds the height of the wind outlet 4 of the fan. Only when the water level rises to the upper portion of the upper wind pipe 9, water will flow into the wind outlet 4 of the fan along the opening on one side of the upper portion of the upper wind pipe 9. However, generally, even if the water level control device fails to function, water in the water tank 2 is insufficient to allow the water level in the trough 3 to rise to the upper portion of the upper wind pipe 9, so that the safety of the fan can be ensured. Also, the wind duct formed by the upper wind pipe and the lower wind pipe should be as short as possible in order to avoid too much wind loss; and, the wind duct needs a large space, and the appearance will be affected if the wind duct is exposed too long. In addition, particularly, the malfunction of the water level control device is less probable. Therefore, the optimal technical effect can be achieved by using a balanced technical solution obtained after comprehensive consideration. Based on statistics, the upper portion of the upper wind pipe is higher than the level of 50% of the maximum water storage capacity of the water tank.

In addition, the water tank 2 and the pedestal 1 are detachably connected in a sealed manner. In this way, the water tank 2 can be separated from the pedestal 2, and the user can carry the water tank 2 and fill it with water separately. The operation is more flexible. This also avoids the flow of water in the water tank 2 out of the humidifier along the junction of the water tank 2 with the pedestal 1.

Embodiment 2

Figure 3:
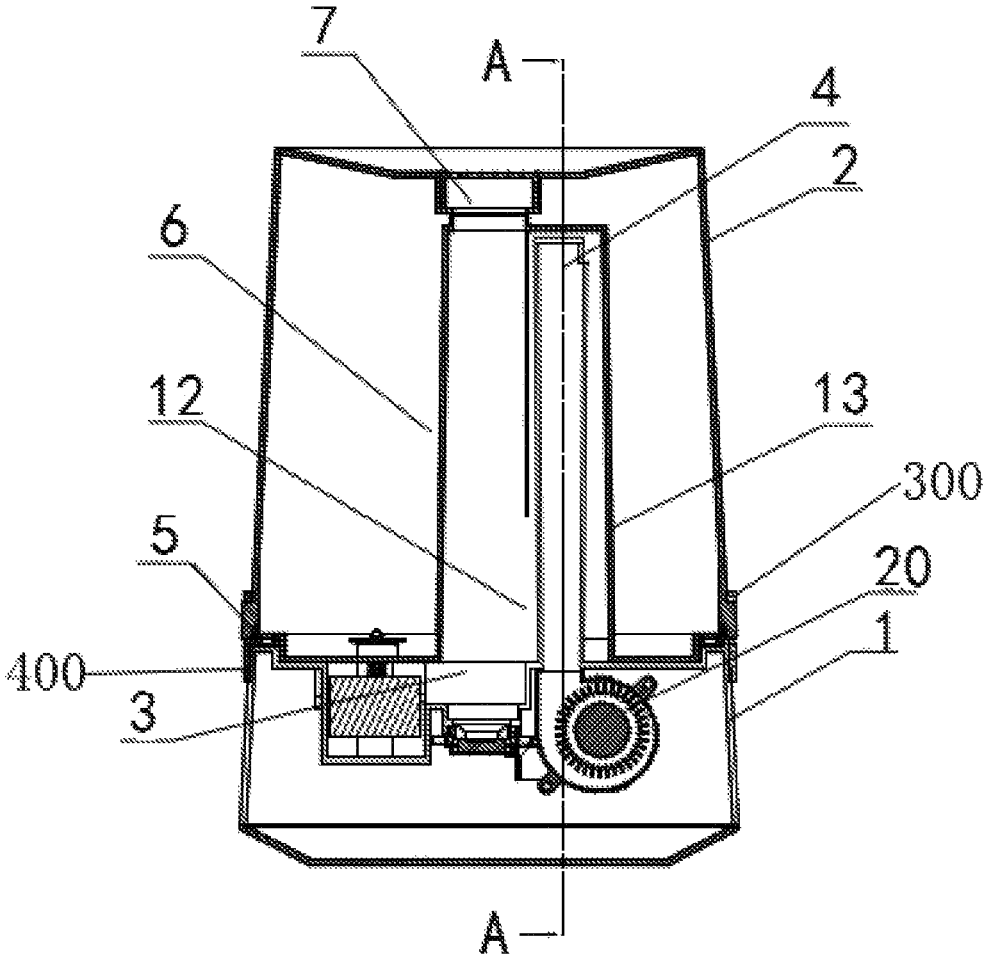
FIG. 3 is a sectional view of a humidifier to which water is supplied from the top in Embodiment 2.
Figure 4:
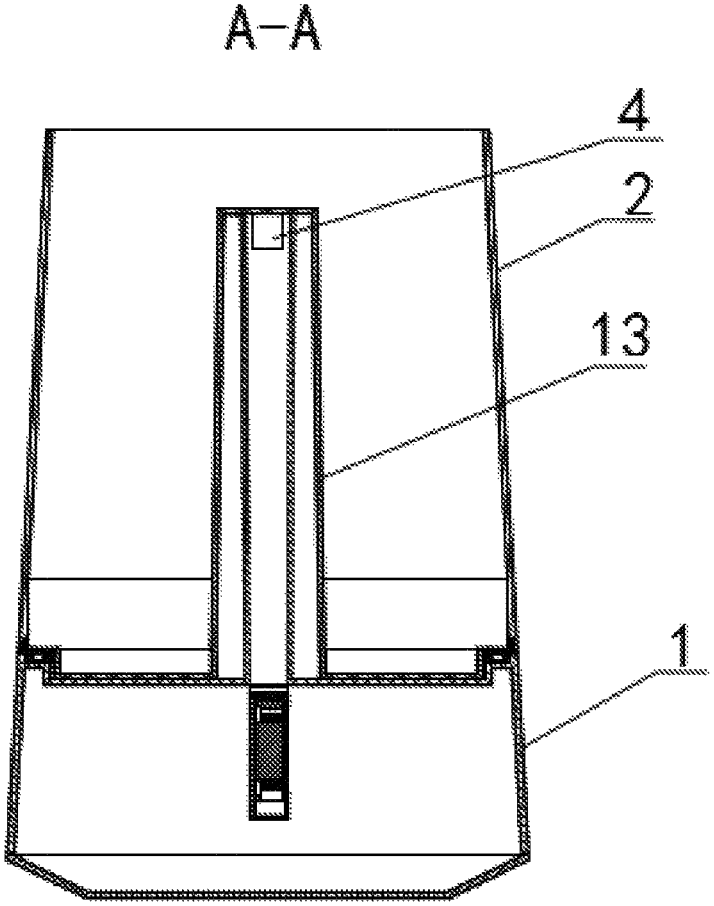
FIG. 4 is a sectional view of FIG. 3 taken along A-A.

Referring to FIGS. 3 and 4, the humidifier to which water is supplied from the top in this embodiment includes a pedestal 1 and a water tank 2 having a water inlet 200 formed on its top surface. A trough 3 is provided on the pedestal 1, and an ultrasonic atomization device is provided in the trough 3. A fan 20 is mounted within the pedestal 1, and a wind outlet 4 of the fan is tubular and exposed upward from the pedestal 1. A water drainage port is formed on the bottom of the water tank 2. A water drainage device is mounted at the water drainage port, and a water level control device configured to control the water drainage device to open or close as per the water level in the trough 3 is mounted in the trough 3. A sealing ring 5 is provided on an edge of the top surface of the pedestal 1, the water tank 2 is arranged on the pedestal 1, and the water tank 2 and the pedestal 1 are detachably connected in a sealed manner. Buckles 300 fitted with each other are provided on the pedestal 1 and the water tank 2. After the water tank 2 is placed on the pedestal 1, the buckles 300 are buckled with each other, so that the firm connection and good sealing between the water tank 2 and the pedestal 1 are ensured.

The water tank 2 is made of plastics, and a mist discharge passage 100 is integrally formed in a middle portion of the water tank 2. The mist discharge passage 100 is formed by connecting a wind pipe 13 and a mist pipe 6 adjacent to each other. A lower portion of the mist pipe 6 is open and right faces the trough 3, the mist pipe 6 is fitted with the trough 3 to form an atomization chamber, and a mist discharge port 7 is formed on the top of the mist pipe 6. The bottom end of the wind pipe 13 is open, and the wind outlet 4 of the fan extends upward into the wind pipe 13 along the opening at the bottom end of the wind pipe 13. The wind outlet 4 of the fan is located in an upper portion of the wind pipe 13, and the wind pipe 13 is communicated with the mist pipe 6 through the wind outlet 12 in the lower portion thereof. When mounting the water tank 2, the wind pipe 13 provided on the water tank 2 is sheathed on the wind outlet 4 of the fan, without connecting the wind pipe 13 with the wind output 4 of the fan in a sealed manner.

The flow direction of wind discharged from the fan of the humidifier is as follows: the fan→the wind outlet 4 of the fan→the wind pipe 13→the mist pipe 6→the mist discharge port 7. Wind discharged from the fan flows from the lower portion of the mist pipe 6 to the atomization chamber successively through the wind outlet 4 of the fan and the wind pipe 13, and then blows out water mist generated within the trough 3 from the mist discharge outlet 7 through the mist pipe 6.

When the water level control device fails to function due to unexpected objects or the like, water in the water tank 2 will continuously flow into the trough 3 until the water level in the trough 3 is flushed with the water level in the water tank 2. Water in the trough 3 will rise along the mist pipe 6, and then flow into the wind pipe 13 through the wind outlet 12 in the lower portion of the wind pipe 13. However, since the wind outlet 4 of the fan is at a higher position, water in the water tank 2 is insufficient to allow the water level in the trough 3 to rise to the upper portion of the upper wind pipe 9, so that the safety of the fan can be ensured. Also, the wind duct formed by the wind discharge path of the fan and the wind pipe 13 should be as short as possible in order to avoid too much wind loss; and, the wind duct needs a large space, and the appearance will be affected if the wind duct is exposed too long. In addition, particularly, the malfunction of the water level control device is less probable. Therefore, the optimal technical effect can be achieved by using a balanced technical solution obtained after comprehensive consideration. Based on statistics, the wind outlet 4 of the fan is higher than the level of 50% of the maximum water storage capacity of the water tank.

Embodiment 3

Figure 5:
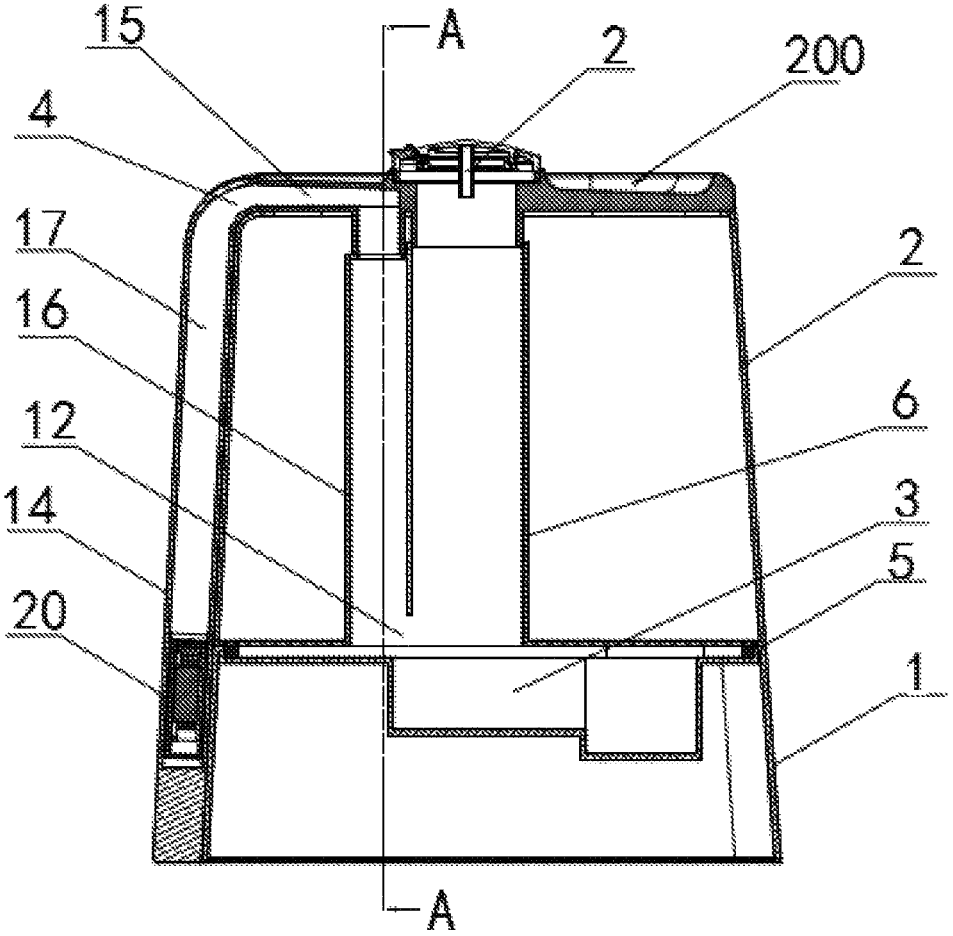
FIG. 5 is a sectional view of a humidifier to which water is supplied from the top in Embodiment 3.
Figure 6:
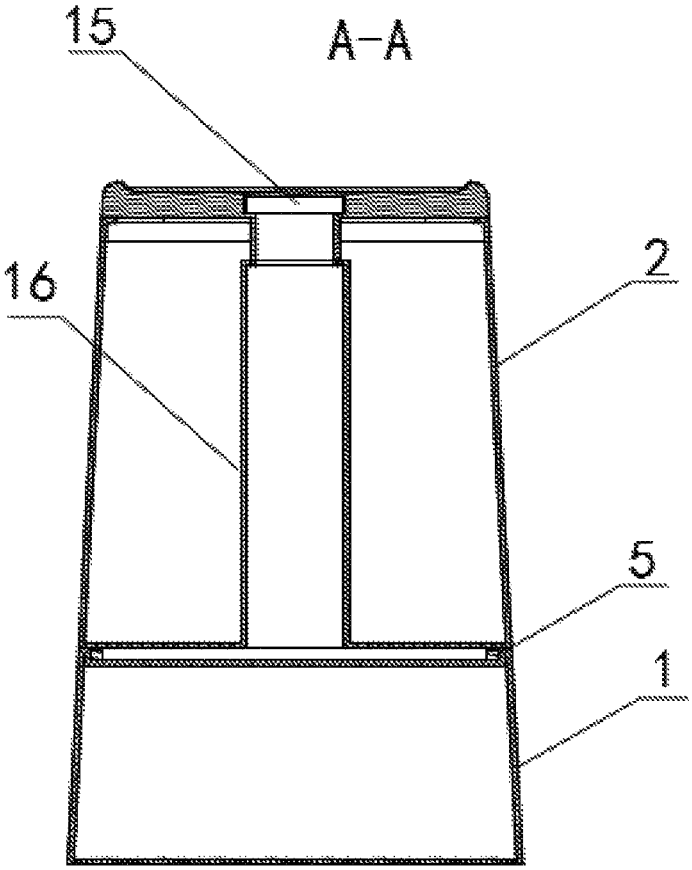
FIG. 6 is a sectional view of FIG. 5 taken along A-A.

Referring to FIGS. 5 and 6, the humidifier to which water is supplied from the top in this embodiment includes a pedestal 1 and a water tank 2 having a water inlet 200 formed on its top surface. A trough 3 is provided on the pedestal 1, and an ultrasonic atomization device is provided in the trough 3. A fan 20 is mounted within the pedestal 1, and a wind outlet 4 of the fan is exposed upward from the pedestal 1. A water drainage port is formed on the bottom of the water tank 2. A water drainage device is mounted at the water drainage port, and a water level control device configured to control the water drainage device to open or close as per the water level in the trough 3 is mounted in the trough 3. A sealing ring 5 is provided on an edge of the top surface of the pedestal 1, the water tank 2 is arranged on the pedestal 1, the water tank 2 and the pedestal 1 are detachably connected in a sealed manner. Buckles 300 fitted with each other are provided on the pedestal 1 and the water tank 2. After the water tank 2 is placed on the pedestal 1, the buckles 300 are buckled with each other, so that the firm connection and good sealing between the water tank 2 and the pedestal 1 are ensured An upwardly protruded panel 14 for mounting a display screen, a key or the like is provided on one side of the pedestal 1, and the wind outlet 4 of the fan is located in an upper portion of the panel 14 and communicated with the fan through a fan wind duct 17 within the panel 14.

The water tank 2 is made of plastics, and a mist discharge passage 100 is integrally formed in a middle portion of the water tank 2. The mist discharge passage 100 is formed by connecting a wind pipe and a mist pipe 6 adjacent to each other. A lower portion of the mist pipe 6 is open and right faces the trough 3, the mist pipe 6 is fitted with the trough 3 to form an atomization chamber, and a mist discharge port 7 is formed on the top of the mist pipe 6. The wind pipe is formed by connecting a horizontal pipe 15 and a vertical pipe 16. The horizontal pipe 15 is located on the top of the water tank 2. After the water tank 2 is placed on the pedestal 1, the horizontal pipe 15 is butt-jointed with the wind outlet 4 of the fan. The wind pipe is communicated with the mist pipe 6 through the wind outlet 12 in the lower portion of the vertical pipe 16.

The flow direction of wind discharged from the fan of the humidifier is as follows: the fan→the fan wind duct 17 within the panel 14→the wind outlet 4 of the fan→the horizontal pipe 15→the vertical pipe 16→the mist pipe 6→the mist discharge port 7. Wind discharged from the fan flows from the lower portion of the mist pipe 6 to the atomization chamber successively through the wind duct 17 of the fan, the wind outlet 4 of the fan, the horizontal pipe 15 and the vertical pipe 16, and then blows out water mist generated within the trough 3 from the mist discharge outlet 7 through the mist pipe 6.

When the water level control device fails to function due to unexpected objects or the like, water in the water tank 2 will continuously flow into the trough 3 until the water level in the trough 3 is flushed with the water level in the water tank 2. Water in the trough 3 will rise along the mist pipe 6, and then flow into the wind pipe through the wind outlet 12 in the lower portion of the wind pipe. However, since the wind outlet 4 of the fan is at a higher position (which reaches the level of 98% of the maximum water storage capacity of the water tank 2), water in the water tank 2 is insufficient to allow the water level in the trough 3 to rise to the height of the wind outlet 4 of the fan, so that the safety of the fan can be ensured.

Embodiment 4

Figure 7:
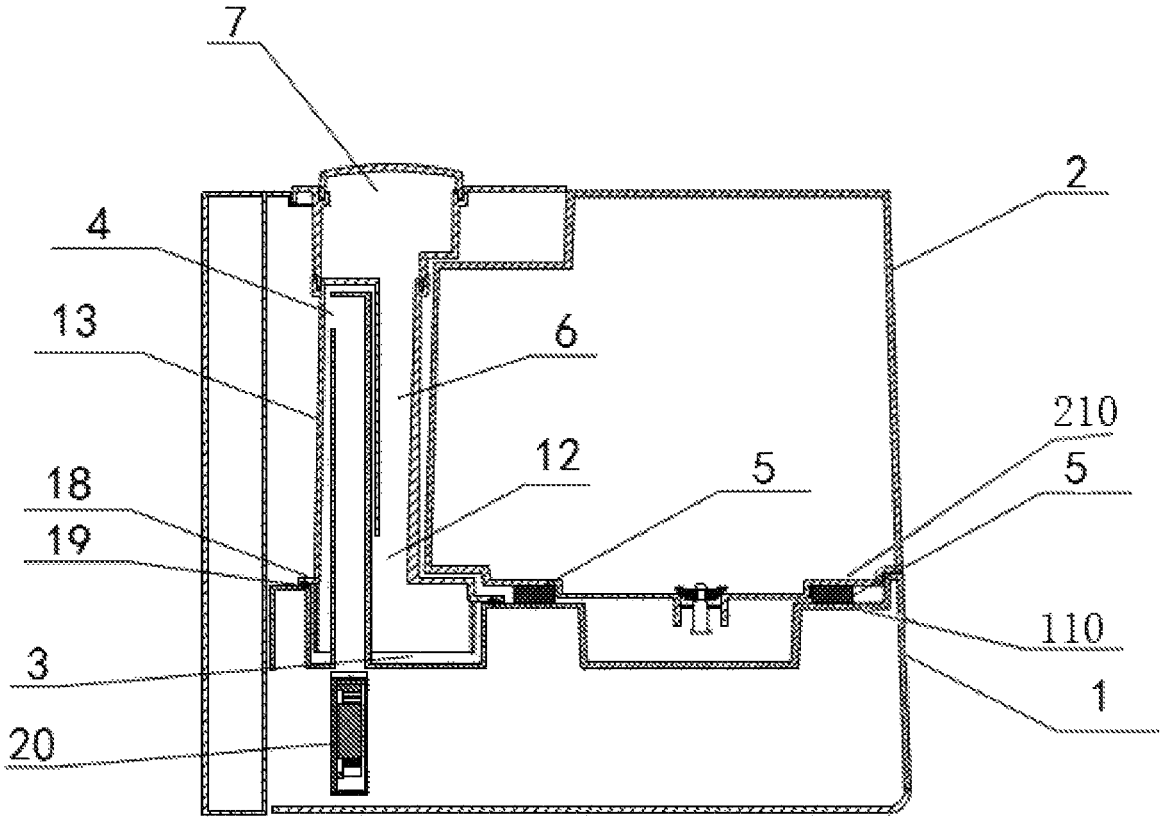

Referring to FIG. 7, similar to the humidifier in Embodiment 2, the humidifier to which water is supplied from the top in this embodiment includes a pedestal 1 and a water tank 2 having a water inlet 200 formed on its top surface. A trough 3 is provided on the pedestal 1, and an ultrasonic atomization device is provided in the trough 3. A fan 20 is mounted within the pedestal 1, and a wind outlet 4 of the fan is tubular and exposed upward from the pedestal 1. A water drainage port is formed on the bottom of the water tank 2. A water drainage device is mounted at the water drainage port, and a water level control device configured to control the water drainage device to open or close as per the water level in the trough 3 is mounted in the trough 3. A sealing ring 5 is provided on an edge of the top surface of the pedestal 1, the water tank 2 is arranged on the pedestal 1, and the water tank 2 and the pedestal 1 are detachably connected in a sealed manner. Buckles 300 fitted with each other are provided on the pedestal 1 and the water tank 2. After the water tank 2 is placed on the pedestal 1, the buckles 300 are buckled with each other, so that the firm connection and good sealing between the water tank 2 and the pedestal 1 are ensured.

A mist discharge passage 100 is formed by connecting a wind pipe 13 and a mist pipe 6 adjacent to each other. A lower portion of the mist pipe 6 is open and right faces the trough 3, the mist pipe 6 is fitted with the trough 3 to form an atomization chamber, and a mist discharge port 7 is formed on the top of the mist pipe 6. The bottom end of the wind pipe 13 is open, and the wind outlet 4 of the fan extends upward into the wind pipe 13 along the opening at the bottom end of the wind pipe 13. The wind outlet 4 of the fan is located in an upper portion of the wind pipe 13, and the wind pipe 13 is communicated with the mist pipe 6 through the wind outlet 12 in the lower portion thereof.

A difference between this embodiment and Embodiment 2 lies in that the mist discharge passage 100 is independent of the water tank 2 and adjacent to the water tank 2. The mist discharge passage 100 is erected over the trough 3 in the pedestal 1 and detachably connected to the pedestal 1 in a sealed manner. The specific structure is as follows: the bottom of the mist discharge passage 100 is inserted into the trough 3; a horizontal rim 18 protruded outward is provided on the mist discharge passage 100, a sealing ring 19 is provided on a bottom surface of the horizontal rim 18, the horizontal rim 18 is erected over an edge of the trough 3, and the sealing ring 19 on the bottom surface of the horizontal rim is compressed onto the pedestal 1, so that the mist discharge passage 100 and the pedestal 1 are connected in a sealed manner. When mounting, the wind pipe 13 of the mist discharge passage 100 is sheathed on the wind outlet 4 of the fan, without connecting the wind pipe 13 with the wind output 4 of the fan in a sealed manner.

The flow direction of wind discharged from the fan of the humidifier is as follows: the fan→the wind outlet 4 of the fan→the wind pipe 13→the mist pipe 6→the mist discharge port 7. Wind discharged from the fan flows from the lower portion of the mist pipe 6 to the atomization chamber successively through the wind outlet 4 of the fan and the wind pipe 13, and then blows out water mist generated within the trough 3 from the mist discharge outlet 7 through the mist pipe 6.

When the water level control device fails to function due to unexpected objects or the like, water in the water tank 2 will continuously flow into the trough 3 until the water level in the trough 3 is flushed with the water level in the water tank 2. Water in the trough 3 will rise along the mist pipe 6, and then flow into the wind pipe 13 through the wind outlet 12 in the lower portion of the wind pipe 13. However, since the wind outlet 4 of the fan is at a higher position which reaches the level of 80% of the maximum water storage capacity of the water tank 2, water in the water tank 2 is insufficient to allow the water level in the trough 3 to rise to the height of the wind outlet 4 of the fan, so that the safety of the fan can be ensured.

The invention claimed is:

1. A humidifier to which water is supplied from a top of the humidifier, including a pedestal, a water tank and a fan, a trough being provided on the pedestal and an atomization device being provided in the trough; a wind outlet of the fan being connected to a mist discharge passage via a wind pipe, and a mist discharge port, from which mist generated by the atomization device is discharged, being formed in the mist discharge passage; a water inlet being formed in an upper portion of the water tank, and a water drainage port being formed on the water tank; a water drainage device being provided at the water drainage port, and the water drainage device being able to be triggered to open or close by receiving an electric signal, a magnetic signal or a mechanical action; on the humidifier to which water is supplied from the top of the humidifier, a water level control device configured to generate the electric signal or the magnetic signal or the mechanical action as per a water level in the trough being provided, the water level control device transferring the electric signal or the magnetic signal or the mechanical action to the water drainage device to control the water drainage device to close or open, wherein the water tank and the pedestal are detachably connected in a sealed manner; the wind outlet of the fan is at or a horizontal section of the wind pipe is at least partially at a height above a level of 50%-98% of a maximum water storage capacity of the water tank;

a wind outlet of the wind pipe is communicated with a mist pipe in a lower portion of the mist pipe, wherein the mist discharge passage is formed by connecting the wind pipe and the mist pipe; the wind pipe is communicated with the wind outlet of the fan; the wind outlet of the wind pipe is communicated with the mist pipe in a lower portion of the mist pipe; and, the mist discharge port is formed in an upper portion of the mist pipe, wherein the wind outlet of the fan is located on the pedestal; the wind pipe consists of a lower wind pipe and an upper wind pipe; a bottom end of the upper wind pipe is open and detachably connected to the wind outlet of the fan in a sealed manner; an upper portion of the upper wind pipe is communicated with the lower wind pipe; and, the wind outlet of the wind pipe is formed in a lower portion of the lower wind pipe, and wherein the bottom end of the upper wind pipe is muff-jointed with the wind outlet of the fan, and a sealing ring or a sealing surface is provided on a contact surface of the upper wind pipe with the wind outlet of the fan.

2. The humidifier to which water is supplied from the top of the humidifier according to claim 1, wherein a bottom end of the wind pipe is open, the wind outlet of the fan extends upward into the wind pipe along an opening at the bottom end of the wind pipe, and the wind outlet of the fan is higher than the wind outlet of the wind pipe.

3. The humidifier to which water is supplied from the top of the humidifier according to claim 1, wherein a bump protruded upward is provided on the pedestal, and the wind outlet of the fan is located in an upper portion of the bump and communicated with the fan through a fan wind duct within the bump; an upper end of the wind pipe is butt-jointed to the wind outlet of the fan, and the wind outlet of the fan is formed at a lower end of the wind pipe.

4. The humidifier to which water is supplied from the top of the humidifier according to claim 1, wherein buckles fitted with each other are provided on the pedestal and the water tank.

5. The humidifier to which water is supplied from the top of the humidifier according to claim 1, wherein the mist discharge passage and the water tank are of an integrated structure.

6. The humidifier to which water is supplied from the top of the humidifier according to claim 1, wherein the pedestal and the water tank are of independent structures, and the mist discharge passage and the pedestal are detachably connected in a sealed manner.

7. The humidifier to which water is supplied from the top of the humidifier according to claim 1, wherein the wind outlet of the fan is higher than or the horizontal section of the wind pipe is at least partially higher than a level of 50% of the maximum water storage capacity of the water tank.

8. The humidifier to which water is supplied from the top of the humidifier according to claim 7, wherein joined end faces of the pedestal and the water tank are sealed detachably.

9. The humidifier to which water is supplied from the top of the humidifier according to claim 8, wherein a sealing ring is provided on a top surface of the pedestal and/or a bottom surface of the water tank.

10. The humidifier to which water is supplied from the top of the humidifier according to claim 8, wherein a sealing surface made of flexible material is provided on a top surface of the pedestal and/or a bottom surface of the water tank.

11. The humidifier to which water is supplied from the top of the humidifier according to claim 7, wherein a side edge of the pedestal and a side edge of the water tank are detachably connected in a sealed manner.

12. The humidifier to which water is supplied from the top of the humidifier according to claim 11, further comprising a sealing sleeve which is sheathed at a junction of the pedestal with the water tank to detachably connect the side edge of the pedestal and the side edge of the water tank in a sealed manner.

13. The humidifier to which water is supplied from the top of the humidifier according to claim 11, wherein a recess and a bump fitted with each other are provided on the side edge of the pedestal and the side edge of the water tank, and a sealing ring is provided on a side wall of the recess and/or a side wall of the bump.

14. The humidifier to which water is supplied from the top of the humidifier according to claim 11, wherein the pedestal and the water tank are detachably connected in a sealed manner by threads formed on the side edges.

15. The humidifier to which water is supplied from the top of the humidifier according to claim 1, wherein a sealing ring or a sealing surface is provided at the bottom end of the upper wind pipe and/or at the wind outlet of the fan.

* * * * *